United States Patent [19]

Nakahara et al.

[11] Patent Number: 5,072,944

[45] Date of Patent: Dec. 17, 1991

[54] THREE-PIECE SOLID GOLF BALL

[75] Inventors: Akihiro Nakahara, Ibaraki; Mikio Yamada, Kobe; Tadahiro Ebisuno; Takashi Sasaki, both of Nishinomiya; Kengo Oka, Kobe, all of Japan

[73] Assignee: Sumitomo Rubber Industries, Ltd., Hyogo, Japan

[21] Appl. No.: 504,675

[22] Filed: Apr. 4, 1990

[30] Foreign Application Priority Data

Apr. 4, 1989 [JP] Japan ..... 1-86110

[51] Int. Cl.[5] ..... A63B 37/12

[52] U.S. Cl. ..... 273/220; 273/218; 273/235 R; 273/230

[58] Field of Search ..... 273/218, 220, 62, 230, 273/231, 235 R, 228, 229

[56] References Cited

U.S. PATENT DOCUMENTS

| | | | |
|---|---|---|---|
| 3,313,545 | 4/1967 | Bartsch | 273/218 |
| 3,784,209 | 1/1974 | Berman et al. | 273/218 |
| 4,570,937 | 2/1986 | Yamada | 273/218 |
| 4,625,964 | 12/1986 | Yamada | 273/220 |
| 4,858,924 | 8/1989 | Saito et al. | 273/235 R |
| 4,919,434 | 4/1990 | Saito | 273/218 |

FOREIGN PATENT DOCUMENTS

| | | | |
|---|---|---|---|
| 60-241464 | 11/1985 | Japan . | |
| 62-181069 | 8/1987 | Japan . | |
| 63-61029 | 11/1988 | Japan . | |
| 2139101 | 11/1984 | United Kingdom | 273/220 |
| 2144043 | 2/1985 | United Kingdom | 273/220 |
| 2185890 | 8/1987 | United Kingdom | 273/220 |
| 2196538 | 5/1988 | United Kingdom | 273/220 |

*Primary Examiner*—George J. Marlo

*Attorney, Agent, or Firm*—Birch, Stewart, Kolasch & Birch

[57] ABSTRACT

Disclosed is a large size three piece solid golf ball comprising a center, an outer layer covering said center to form a solid core and a cover covering said solid core, wherein said center has a diameter of 15 to 24 mm and a center hardness of 25 to 50 (JIS-C), prepared from a rubber composition comprising 100 parts by weight of cis-1,4-polybutadiene, 9 to 20 parts by weight of zinc acrylate and 3 to 150 parts by weight of a zinc oxide, said solid core has a diameter of 36 to 40 mm and a surface hardness of 70 to 90 (JIS-C), a difference between the center hardness and the surface hardness of the solid core is 20 or more and the specific gravity of the center and the outer layer has the following relation;

a specific gavity of the center ≧ a specific gravity of the outer layer, and the specific gravity of the center ≧ 1.1.

4 Claims, 1 Drawing Sheet

THREE-PIECE SOLID GOLF BALL

FIELD OF THE INVENTION

The present invention relates to a large size three piece solid golf ball which is excellent in impact resilience and flying distance.

BACKGROUND OF THE INVENTION

Many patent applications directed to three piece solid golf balls have been filed, but balls which are superior to two piece solid golf balls, especially in impact resilience, flying properties, durability and hitting feeling, have not been developed yet. Three piece solid golf balls which has a large size and good properties are more desired.

Japanese Kokoku Publication No. 61029/1988 proposes that a specific gravity of a center core is higher than that of an outer layer, and a diameter of the center core is made larger in order to impart high impart resilience and good hitting feeling to the three piece golf ball. Sufficient specific gravity difference can be obtained in small size golf balls, but it is difficult to impart good properties to large size golf balls. Durability of a golf ball is apt to be reduced in the large size three piece solid golf ball.

Japanese Kokai Publication (unexamined) 181069/1987 also proposes that the center core is made soft and reduces its diameter to 24 to 29 mm to impart a specific gravity difference between the center core having a high specific gravity and the outer layer having a low specific gravity. The proposed golf balls, however, are inferior to conventional two piece solid golf balls in impact resilience and flying distance. Also, since the center core of the golf balls is prepared from TMPT (U.S. Pat. No. 3,313,545) which is rarely employed for golf balls, durability is poor.

In order to provide high impact resilience and good hitting feeling, Japanese Kokai Publication No. (unexamined) 241464/1985 proposes that a specific gravity difference is formed between the center core having a high specific gravity and the outer layer having a low specific gravity and the center core is made softer to lower moment of inertia of a golf ball. The golf ball has improved feeling when it is hit, however is inferior to a two piece golf ball in impact resilience.

The present inventors have found that the proposed methods are all suitable for a small size three piece solid golf ball, but are not suitable for large size one. In other words, the large size three piece solid golf balls needs unique constructions which are different from small size one.

SUMMARY OF THE INVENTION

The present invention provides a large size three piece solid golf ball which has improved impact resilience and good feeling when the ball is hit and excellent in flying properties (e.g. flying distance) and durability. The golf ball comprises a center core, an outer layer covering the center core to form a solid core and a cover covering the solid core, wherein the center has a diameter of 15 to 24 mm and a center hardness of 25 to 50 (JIS-C), prepared from a rubber composition comprising 100 parts by weight of cis-1,4-polybutadiene, 9 to 20 parts by weight of zinc acrylate and 3 to 150 parts by weight of zinc oxide, the solid core has a diameter of 36 to 40 mm and a surface hardness of 70 to 90 (JIS-C), a difference between the center core hardness and the surface hardness of the solid core is 20 or more and the specific gravity of the center core and the outer layer has the following relation;

a specific gravity of the center core $\geqq$ a specific gravity of the outer layer, and the specific gravity of the center core $\geqq 1.1$.

DETAILED DESCRIPTION OF THE INVENTION

Figure 1:
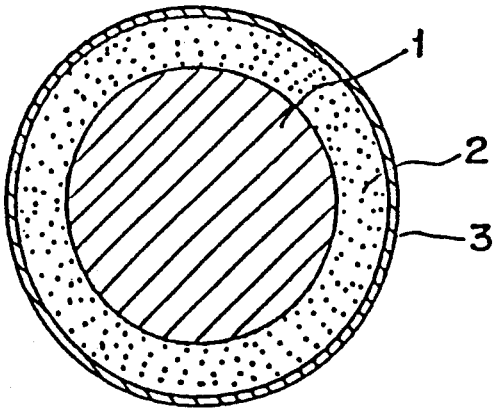
FIG. 1 is a sectional view which shows a general construction of a three piece solid golf ball.

A three piece solid golf ball, as shown in FIG. 1, has a construction of a solid core composed of a center core (1) and an outer layer (2), and a cover (3) covering the solid core. The center core (1) and the outer layer (2), i.e. the solid core, is generally prepared by curing a rubber composition. The rubber composition contains the same components as used in a solid core of a two piece solid golf ball, such as a base rubber (cis-1,4-polybutadiene, natural rubber etc.), a crosslinking agent (an organic peroxide etc.), a co-crosslinking agent (a metallic salt of an unsaturated fatty acid, etc.) and other additives (zinc oxide etc). The center core of the present invention is prepared from a rubber composition which comprises cis-1,4-polybutadiene (base rubber), zinc acrylate (crosslinking agent) and zinc oxide (additives), which provides with good durability and excellent flying properties. An amount of zinc acrylate is 9 to 20 parts by weight, preferably 10 to 15 based on 100 parts by weight of cis-1,4-polybutadiene. Amounts of less than 9 parts by weight reduce the durability of the obtained golf ball. Amounts of more than 20 parts by weight cure a center core hardness of more than 50 which is too hard. An amount of zinc oxide is 3 to 150 parts by weight based on 100 parts by weight of cis-1,4-polybutadiene. The amounts are varied by the specific gravity of the center core and the outer layer, and a weight standard of golf balls.

The outer layer can be prepared from any rubber composition which is used in this field, but preferably the composition contains cis-1,4-polybutadiene (base rubber) and zinc acrylate (co-crosslinking agent). An amount of zinc acrylate is 25 to 45 parts by weight based on 100 parts by weight of cis-1,4-polybutadiene. Amounts of less than 25 parts by weight reduce hardness and deteriorate impact resilience and durability. Amounts of more than 45 parts by weight are too hard and poor in feeling when it is hit.

The rubber composition for the center core may be prepared by mixing the components mentioned above, using a kneader or a roll. The composition is molded and heated to a temperature sufficient for the crosslinking agent and co-crosslinking agent to act upon, preferably about 150° to 170° C. to form a solid core having a diameter of 15 to 24 mm, preferably 17 to 22 mm. Diameters of less than 15 mm make the outer layer too thick and deteriorate feeling when the ball is hit. Diameters of more than 24 mm make the feeling very soft and reduce durability.

According to the present invention, it is very important that a hardness (JIS (Japanese Industrial Standard) -C) of the center core is adjusted within the range of 25 to 50, preferably 30 to 45 at center by controlling curing conditions (e.g. rate of elevating temperature, curing temperature, time for curing etc.). If a hardness is less than 25 at center, feeling is too soft and durability is poor. If it is more than 50, the obtained ball is too hard and very poor in feeling when it is hit.

The solid core of the present invention is prepared by forming the outer layer on the above obtained center core. Thus, the rubber composition for the outer layer may be concentrically covered on the center core and then cured at a temperature sufficient for the crosslinking agent and the co-crosslinking agent to act upon to form a solid core having a diameter of 36 to 40 mm. If the solid core has a diameter of less than 35 mm, a thick cover is formed and makes feeling bad, thus deteriorating impact resilience. If it is more than 40 mm, a cover is too thin and poor in durability.

A surface hardness (JIS-C) of the solid core is within the range of 70 to 90, preferably 75 to 85. Surface hardness of less than 70 deteriorate durability and impact resilience and those of more than 90 are poor in feeling when the ball is hit, although impact resilience is enhanced.

According to the present invention, it is required that a difference between the center hardness and the surface hardness of the solid core is 20 or more. In other words, it is desired that the center core is softer than the outer layer. It has been found that the softer the center core, the less the impact shock when the ball is hit. Also, a high hardness of the outer layer enhances impact resilience. If the difference is less than 20, impact resilience reduces and impact shock increases.

A specific gravity of the center core and the outer layer is also important in the present invention and meets the following relation;

A specific gravity of the center core $\geqq$ a specific gravity of the outer layer, and a specific gravity $\geqq 1.1$.

In order to impart more improved impact resilience to the ball than that of two piece solid golf balls, it is more preferred that a specific gravity of the center core is much higher than that of the outer layer. If a specific gravity of the center core is smaller than that of the outer layer, the impact resilience of the golf ball is inferior to that of the two piece solid golf balls. Also, if a specific gravity of the center core is less than 1.1, it is difficult to adjust a specific gravity of the center core to more than that of the outer layer, and impact resilience is poor.

The above construction of the solid core lowers spin of the golf ball to fly far and extends an angle of the ball starting to fly. The obtained three piece solid golf ball is superior to the conventional two piece golf ball in flying distance and feeling when it is hit.

The solid core obtained above is covered with a cover of 0.9 to 2.9 mm thickness. The cover is prepared from an ionomer resin and optionally an organic filler for coloring and the like (e.g. titanium dioxide, zinc oxide etc.). The ionomer resin is a thermoplastic resin which is prepared by polymerizing a mono-olefin and 4 to 30% by weight of a monomer selected from the group consisting of a $C_3$–$C_8$ mono- or di-carboxylic acid and an ester thereof to form a polymer to which crosslinking bonds through metal atoms are formed. The ionomer resin is available from Du Pont Company under the tradename of "Surlyn", such as Surlyn 1601, 1707, 1605 and the like. The ionomer resin can be combined.

The covering method can be any methods used in this field, generally an injection molding of the cover resin or a method wherein the solid core is covered with spherical half shells of the cover resin and pressure-molded with heating.

The large size three piece solid golf ball of the present invention has excellent durability equal to the conventional two piece solid golf ball, but is superior to the two piece golf ball in impact resilience and feeling when the ball is hit.

EXAMPLES

The present invention is illustrated with the following examples which, however, are not to be construed as limiting the present invention to their details. Provided that measuring positions of hardness distribution are always expressed as a distance from the center of the center core, thus 5–10 mm showing 5 to 10 mm distance apart from the center.

Examples 1 to 5 and Comparative Examples 1 to 6

Preparation of a center core

A rubber composition was prepared by mixing the ingredients for the center core shown in Table 1 and vulcanized at 150° C. for 30 minutes to form a center core.

Preparation of solid core

A rubber composition was prepared by mixing the ingredients for the outer layer shown in Table 1 and concentrically molded on the center core at 155° C. for 30 to 40 minutes to obtain a solid core.

Preparation of a golf ball

The solid core obtained above was covered with a cover resin which was prepared from the ingredients for the cover resin shown in Table 1 by injection molding to form a large size three piece solid golf ball. Physical properties of the obtained golf ball were evaluated and the result are shown in Table 1.

Comparative Example 7

Physical properties of a high grade two piece solid golf ball commercially available were evaluated and the result are shown in Table 1.

TABLE 1

| | | | Examples No. | | | | | Comparative Examples No. | | | | | | |
|---|---|---|---|---|---|---|---|---|---|---|---|---|---|---|
| | | | 1 | 2 | 3 | 4 | 5 | 1 | 2 | 3 | 4 | 5 | 6 | 7 |
| Solid core | Center core | Cis-1,4-polybutadiene[1] | 100 | 100 | 100 | 100 | 100 | 100 | 100 | 100 | 100 | 100 | 100 | * |
| | | Zinc acrylate | 10 | 10 | 10 | 10 | 18 | 10 | 21 | 10 | 10 | 13 | — | |
| | | TMPT | — | — | — | — | — | — | — | — | — | — | 13 | |
| | | Zinc oxide | 28.4 | 86.7 | 28.4 | 60.4 | 28.5 | 28.4 | 24.4 | 13.2 | 28.4 | 11.9 | 33.3 | |
| | | Antiaging agent | 0.5 | 0.5 | 0.5 | 0.5 | 0.5 | 0.5 | 0.5 | 0.5 | 0.5 | 0.5 | 0.5 | |
| | | Dicumyl peroxide | 1.4 | 1.4 | 1.4 | 1.4 | 1.0 | 1.4 | 1.0 | 1.4 | 1.5 | 1.5 | 2.0 | |
| | | Diameter (mm) | 17 | 17 | 21 | 21 | 24 | 10 | 21 | 21 | 27 | 27 | 21 | |
| | | Specific gravity | 1.151 | 1.500 | 1.151 | 1.350 | 1.170 | 1.151 | 1.151 | 1.050 | 1.151 | 1.050 | 1.151 | |
| | | Center hardness (JIS-C)[2] | 38 | 40 | 40 | 41 | 45 | 37 | 57 | 40 | 43 | 44 | 41 | |
| Solid | Outer | Cis-1,4- | 100 | 100 | 100 | 100 | 100 | 100 | 100 | 100 | 100 | 100 | 100 | |

TABLE 1-continued

| | | | Examples No. | | | | | Comparative Examples No. | | | | | | |
|---|---|---|---|---|---|---|---|---|---|---|---|---|---|---|
| | | | 1 | 2 | 3 | 4 | 5 | 1 | 2 | 3 | 4 | 5 | 6 | 7 |
| core layer | | polybutadiene | | | | | | | | | | | | |
| | | Zinc acrylate | 28 | 34 | 34 | 36 | 27 | 34 | 34 | 34 | 34 | 34 | 34 | |
| | | Zinc oxide | 22.0 | 13.8 | 19.9 | 12.0 | 25.6 | 19.9 | 19.9 | 22.7 | 19.9 | 28.4 | 19.9 | |
| | | Antiaging agent | 0.5 | 0.5 | 0.5 | 0.5 | 0.5 | 0.5 | 0.5 | 0.5 | 0.5 | 0.5 | 0.5 | |
| | | Dicumyl peroxide | 1.5 | 1.5 | 1.5 | 1.5 | 1.5 | 1.5 | 1.5 | 1.5 | 1.5 | 1.5 | 1.5 | |
| | | Specific gravity | 1.151 | 1.115 | 1.151 | 1.109 | 1.170 | 1.151 | 1.151 | 1.167 | 1.151 | 1.200 | 1.151 | |
| | | Surface hardness (JIS-C)[3] | 80 | 85 | 86 | 87 | 76 | 85 | 86 | 86 | 87 | 87 | 86 | |
| | | Diameter (mm) | 38.4 | 38.4 | 38.4 | 38.4 | 38.0 | 38.4 | 38.4 | 38.4 | 38.4 | 38.4 | 38.4 | 38.4 |
| Cover | Compositon (wt. parts) | Ionomer resin[4] | 100 | 100 | 100 | 100 | 100 | 100 | 100 | 100 | 100 | 100 | 100 | |
| | | Titanium dioxide | 3 | 3 | 3 | 3 | 3 | 3 | 3 | 3 | 3 | 3 | 3 | |
| | Thickness (mm) | | 2.2 | 2.2 | 2.2 | 2.2 | 2.4 | 2.2 | 2.2 | 2.2 | 2.2 | 2.2 | 2.2 | 2.2 |
| | Hardness (shore D) | | 70 | 70 | 70 | 70 | 70 | 70 | 70 | 70 | 70 | 70 | 70 | 70 |
| Ball physical properties | Ball weight (g) | | 45.3 | 45.2 | 45.3 | 45.2 | 45.2 | 45.2 | 45.2 | 45.3 | 45.2 | 45.3 | 45.3 | 45.2 |
| | Compression of the ball (PGA) | | 93 | 102 | 100 | 101 | 100 | 102 | 105 | 100 | 103 | 105 | 100 | 102 |
| | Ball initial velocity (m/s)[5] | | 65.0 | 65.2 | 65.3 | 65.5 | 65.2 | 63.2 | 64.1 | 63.7 | 63.5 | 63.6 | 64.1 | 64.2 |
| | Hammering durability[6] | | 100 | 102 | 102 | 102 | 105 | 93 | 103 | 102 | 99 | 98 | 92 | 100 |
| | Feeling[7] | | | | ◎ | ◎ | | Δ | Δ | | | | | × |

*Two piece ball commercially available.
[1]BR-11 available from Japan Synthetic Rubber Industries Co., Ltd.
[2]The core was cut in half and the surface was smoothened. The center hardness was measured using a JIS-C hardness meter according to JIS K-6301.
[3]The surface hardness of the core was measured using a JIS-C hardness meter according to JIS K-1605.
[4]A 50/50 mixture of Surlyn 1605 and 1706.
[5]Calculated from an initial velocity of a golf ball, when a cylindrical material of 198.4 g was struck to the ball at 45 m/s
[6]A golf ball was struck to a board at a speed of 45 m/s at a temperature of 23° C. and number of striking was determined until the ball was cracked. The number is expressed as an index number when the number of Comparative Example 1 is made 100.
[7]Feeling when the ball was hit by professional golf player;
◎ Excellent shows very good feeling.
Good shows good feeling.
Δ Fairly good shows too soft or slightly hard.
× Bad shows too hard.

Comparative Example 1 shows that, if the center core has a diameter of less than 15 mm, feeling is bad. Comparative Example 2 shows that, if the center core has a center hardness of more than 50, feeling is bad. Comparative Examples 3 and 5 show that, if a specific gravity of the center core is less than that of the outer layer, impact resilience which is expressed by initial velocity is reduced. Comparative Examples 4 and 5 show that, if the center core has a diameter of more than 24 mm, durability and impact resilience are poor. Comparative Example 6 shows that, if zinc acrylate in the center core as co-crosslinking agent is not employed, durability is poor. The two piece solid golf ball commercially available is inferior to the golf ball of the present invention in impact resilience, durability and feeling. Examples 2 and 4 show that, if a specific gravity of the center core is larger than that of the outer layer, impact resilience enhances.

What is claimed is:

1. A large size three piece solid golf ball comprising a center core, an outer layer covering said center core to form a solid core and a cover covering said solid core, wherein said center has a diameter of 15 to 24 mm and a center hardness of 25 to 50 (JIS-C), prepared from a rubber composition comprising 100 parts by weight of cis-1,4-polybutadiene, 9 to 20 parts by weight of zinc acrylate and 3 to 150 parts by weight of zinc oxide, said solid core has a diameter of 36 to 40 mm and a surface hardness of 70 to 90 (JIS-C), a difference between the center hardness and the surface hardness of the solid core is 20 or more and the specific gravity of the center core and the outer layer has the following relation;

a specific gravity of the center core ≧specific gravity of the outer layer, and the specific gravity of the center core ≧1.1.

2. The large size three piece solid golf ball according to claim 1 wherein said center core has a hardness of 30 to 45 (JIS-C).

3. The large size three piece solid golf ball according to claim 1 wherein said solid core has a surface hardness of 75 to 85 (JIS-C).

4. The large size three piece solid golf ball according to claim 1 wherein said cover has a thickness of 0.9 to 2.9 mm.

* * * * *